US006337963B1

(12) United States Patent
Kusayanagi

(10) Patent No.: US 6,337,963 B1
(45) Date of Patent: Jan. 8, 2002

(54) TONER RECOVERY SYSTEM WITH ELECTRICAL POTENTIAL SEPARATION FOR A WET IMAGE-FORMING APPARATUS

(75) Inventor: Toshiya Kusayanagi, Niigata (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/427,998

(22) Filed: Oct. 27, 1999

(30) Foreign Application Priority Data

Oct. 27, 1998 (JP) ..... 10-305722

(51) Int. Cl.[7] ..... G03G 15/10
(52) U.S. Cl. ..... 399/237; 399/240
(58) Field of Search ..... 399/237–239, 399/249; 15/256.5, 256.51, 256.52

(56) References Cited

U.S. PATENT DOCUMENTS 5,893,012 A * 4/1999 Schubert et al. ..... 399/237
6,094,553 A * 7/2000 Shima ..... 399/237

FOREIGN PATENT DOCUMENTS

JP 55-71354 11/1953
JP 10-274885 10/1998

OTHER PUBLICATIONS

Japanese Office Action issued Sep. 5, 2000 in a related application with English translation of relevant portions.

* cited by examiner

*Primary Examiner*—William J. Royer
(74) *Attorney, Agent, or Firm*—Ostrolenk, Faber, Gerb & Soffen, LLP

(57) ABSTRACT

A wet image-forming apparatus including a developing roller for developing latent images on a photoreceptor with a liquid developer, a developing blade for removing toner particles adhering to the surface of the developing roller, a brush roller for removing the toner particles from the developing blade, and a reservoir which stores the liquid developer, wherein substantially the same voltages as a developing voltage applied to the developing roller are applied to the brush roller and the reservoir. Since substantially the same voltages are applied at least to the brush roller, the reservoir and the developing roller, the apparatus of the present invention does not generate the accumulation of the toner particles.

5 Claims, 5 Drawing Sheets

TONER RECOVERY SYSTEM WITH ELECTRICAL POTENTIAL SEPARATION FOR A WET IMAGE-FORMING APPARATUS

BACKGROUND OF THE INVENTION (a) Field of the Invention

The present invention relates to a wet image-forming apparatus, and in particular, to a wet image-forming apparatus employing a liquid developer used in an electrophotographic printer.

(b) Description of the Related Art

A conventional wet image-forming apparatus shown in FIG. 1 includes a developing roller 11 which rotates in a direction shown by an arrow "b" for developing electrostatic latent images formed on a photoreceptor B, a developing blade 12 for removing toner particles on the developing roller 11, a brush roller 13*a* for removing the toner particles from the developing blade 12, a manifold 14 for supplying a liquid developer to the developing roller 11, a reservoir 15*a* for storing the liquid developer in order to dip the brush roller 13*a* in the liquid developer during printing, a shield 17 for controlling the flow of the liquid developer, a squeezing roller 18 for removing the excessive developer on the photoreceptor B during the printing and for cleaning the photoreceptor B immediately before the stopping of the apparatus, a wiping blade 19 which is pressed against the squeezing roller 18 during the cleaning of the photoreceptor B, a squeezing support 20 which supports the squeezing roller 18 and the wiping blade 19 and shifts the vertical positions thereof with respect to the developing roller 11, and a developing support 21 for supporting the developing roller 11, the manifold 14, the reservoir 15*a* and the other elements.

Because of a difference between the electrified potential of the photoreceptor B and the developing potential $V_D$ applied to the developing roller 11, an electric field which is reverse to that of the exposed portion of the photoreceptor B is generated on the non-exposed portion of the photoreceptor B during the printing. The electric field causes the toner particles to adhere to the developing roller 11 in a reverse image developing process. The apparatus of FIG. 1 has a disadvantage in that it is difficult to keep a developing gap constant, and also in that the developing roller 11 requires cleaning. For cleaning purposes, the developing blade 12 is pressed against the outer peripheral surface of the developing roller 11 to remove the toner particles, while the toner particles adhering to the developing blade 12 are removed with the brush roller 13*a*. The brush roller 13*a* is manufactured by incorporating synthetic insulating resin fibers, such as rayon and nylon, on a cylindrical member. The reservoir 15*a* is also made of an insulating material.

As described above, the toner particles adhering to the developing blade 12 are removed with the brush roller 13*a*. Accordingly, the toner particles are gradually accumulated on the brush roller 13*a*.

When the accumulation of toner particles becomes excessive, the brushing roller 13*a* can no longer remove the toner particles adhering to the developing blade 12. The developing roller 11 under these conditions cannot be sufficiently cleaned.

If the liquid developer in the reservoir 15*a* is depleted upon the completion of printing, the toner particles adhering to the brush roller 13*a* are dried and coagulated, causing an increase in torque when the brush roller 13*a* is rotated. The dried and coagulated toner particles can cause damage to the developing blade 12 in the next printing.

SUMMARY OF THE INVENTION

In view of the foregoing, an object of the present invention is to provide a wet image-forming apparatus which prevents toner particles contained in a liquid developer from accumulating on a brush roller to overcome the above problems in the conventional art.

The present invention provides a wet image-forming apparatus including: a developing roller which rotates in a first direction for developing electrostatic latent images formed on a photoreceptor with a liquid developer; a developing blade disposed in contact with a surface of the developing roller for removing toner particles adhering to the surface of the developing roller after developing; a brush roller which rotates in the first direction for removing the toner particles from the developing blade; and a reservoir which stores the liquid developer for accommodating both of the developing blade and the brush roller to dip both in the liquid developer, wherein the developing roller, the brush roller and the reservoir are applied with a common developing voltage.

In accordance with the wet image-forming apparatus of the present invention, toner particles that adhere to the developing blade can be mechanically and electrically prevented from accumulating. Cleaning of the developing roller can be accomplished effectively because substantially the same voltages as the developing voltage are applied to the brush roller and the reservoir.

The above and other objects, features and advantages of the present invention will be more apparent from the following description.

PREFERRED EMBODIMENTS OF THE INVENTION

Now, the present invention is more specifically described with reference to accompanying drawings.

Figure 1:
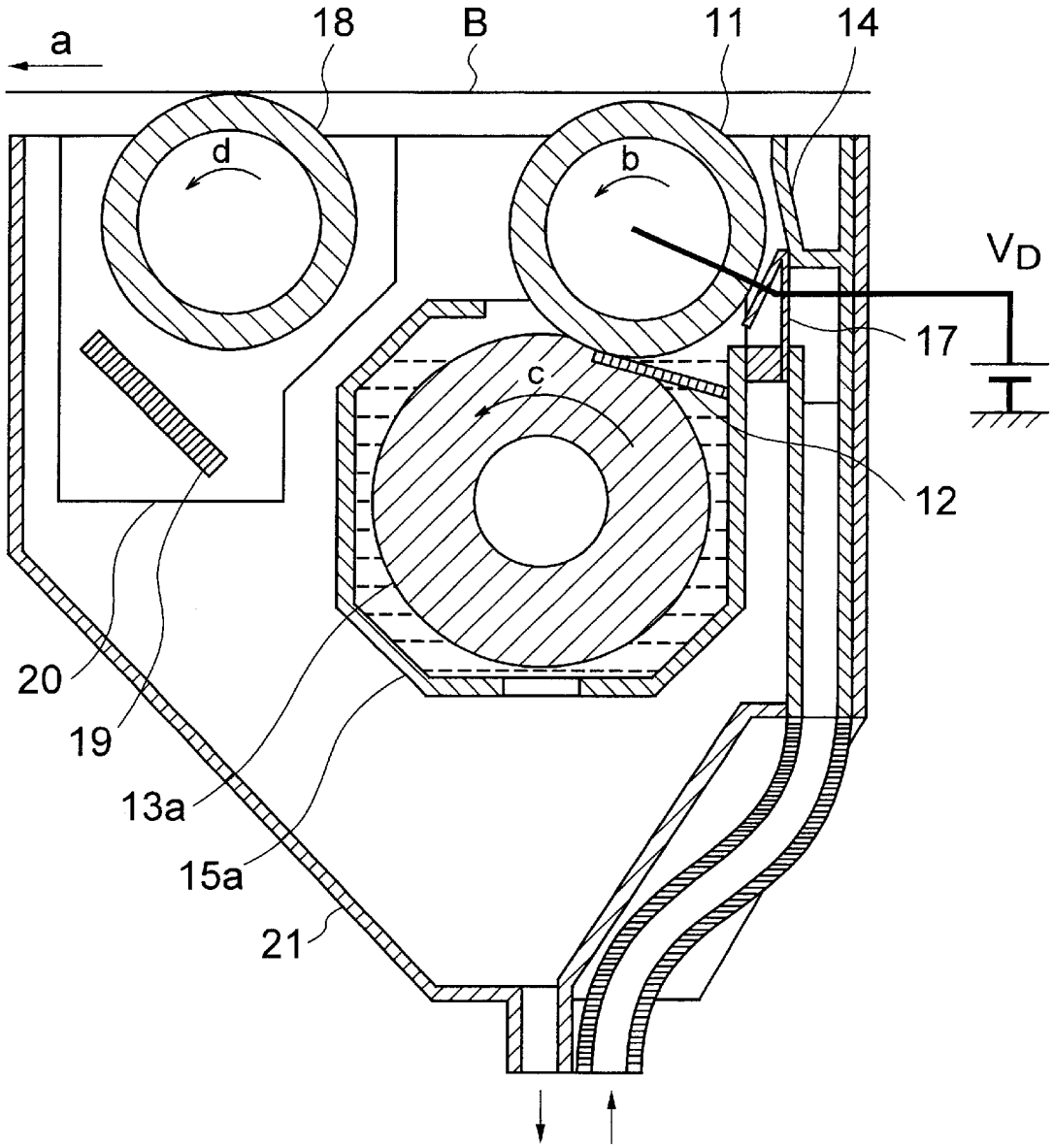
FIG. 1 PRIOR ART
FIG. 1 is a vertical sectional view showing a main portion of a conventional wet image-forming apparatus.
Figure 2:
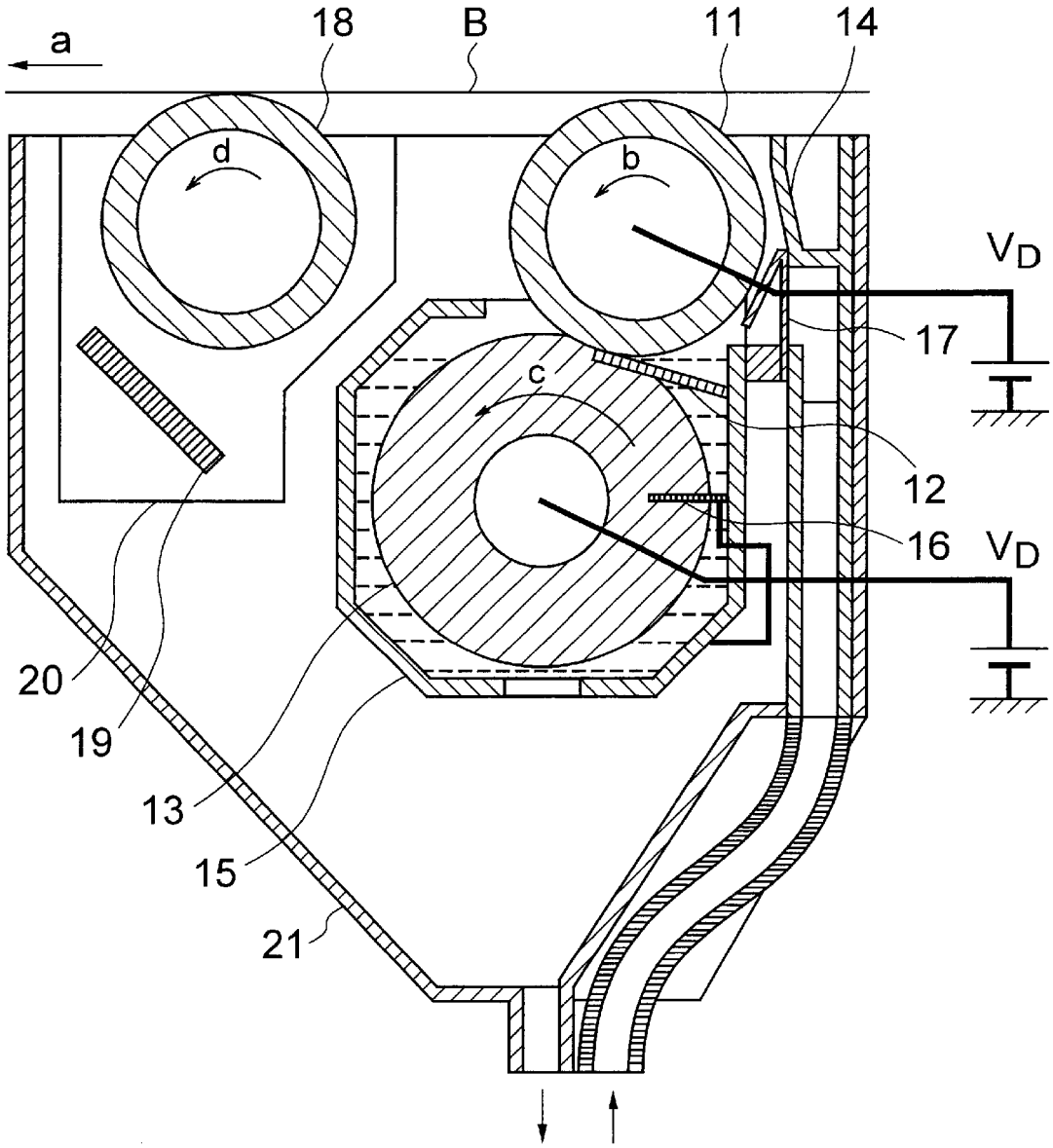
FIG. 2 is a vertical sectional view showing a main portion of an embodiment of a wet image-forming apparatus during printing in accordance with the present invention.
Figure 3:
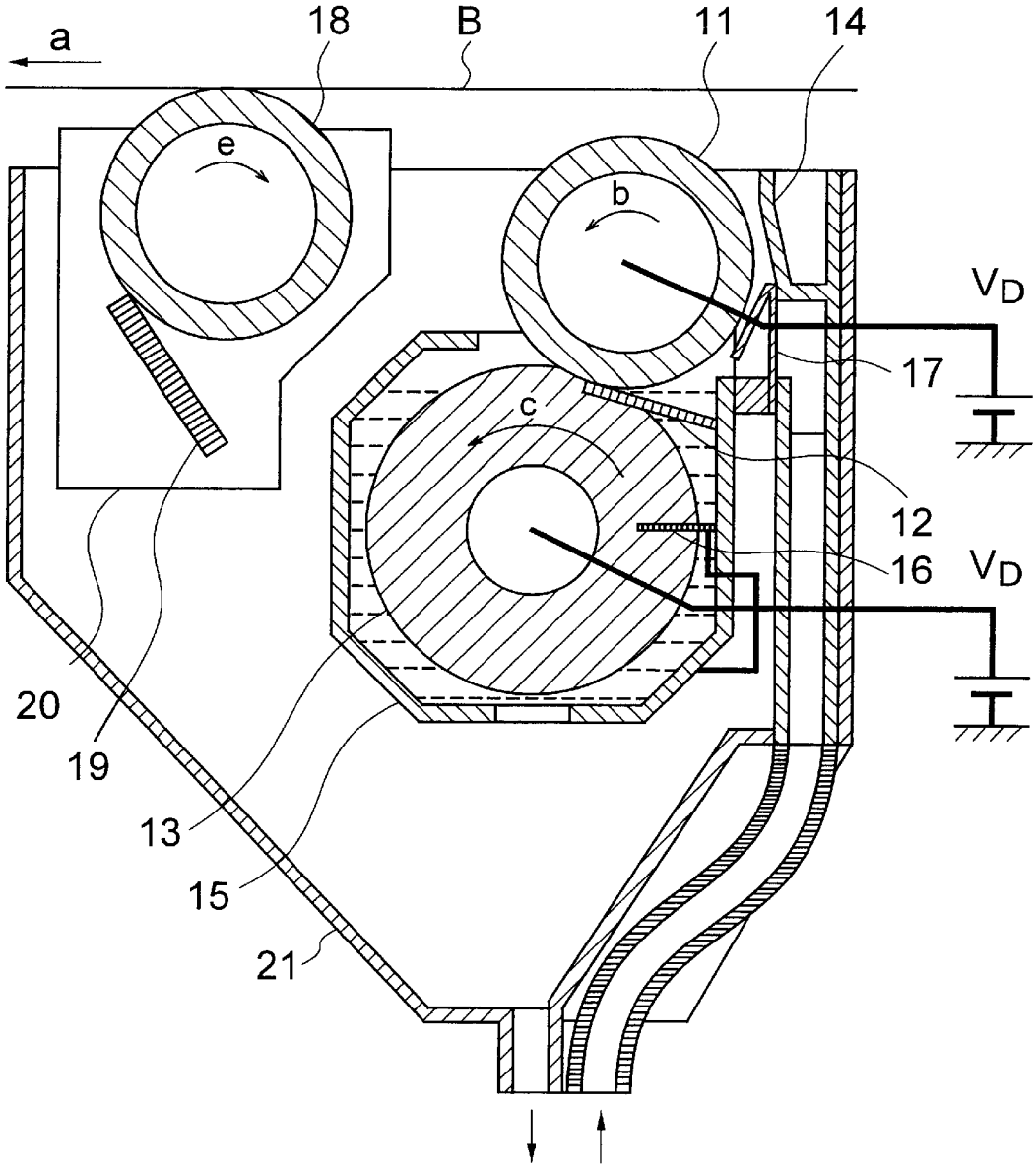
FIG. 3 is a vertical sectional view showing the apparatus of FIG. 2 immediately before completion of printing.
Figure 4:
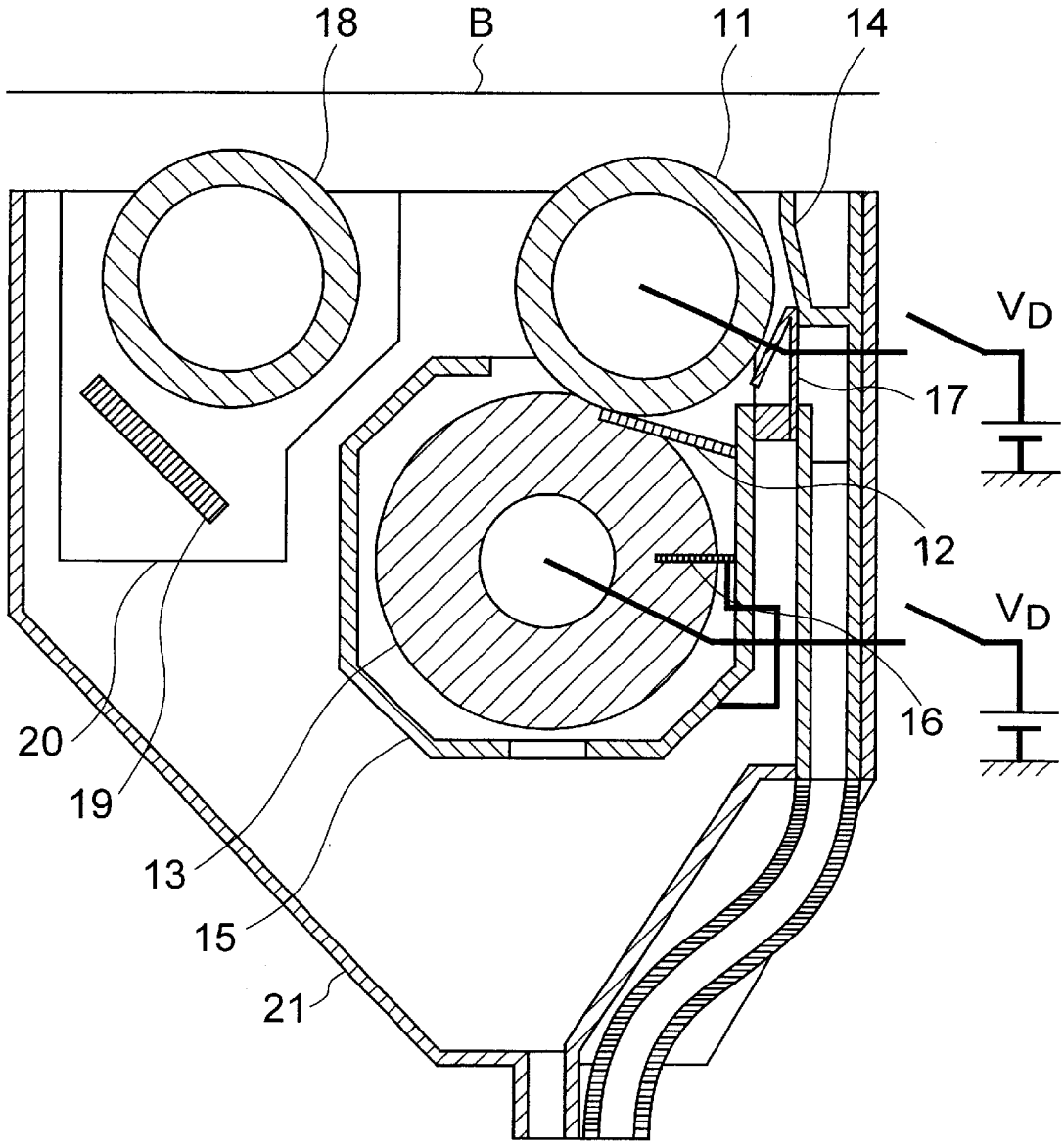
FIG. 4 is a vertical sectional view showing the apparatus of FIG. 2 after the completion of printing.
Figure 5:
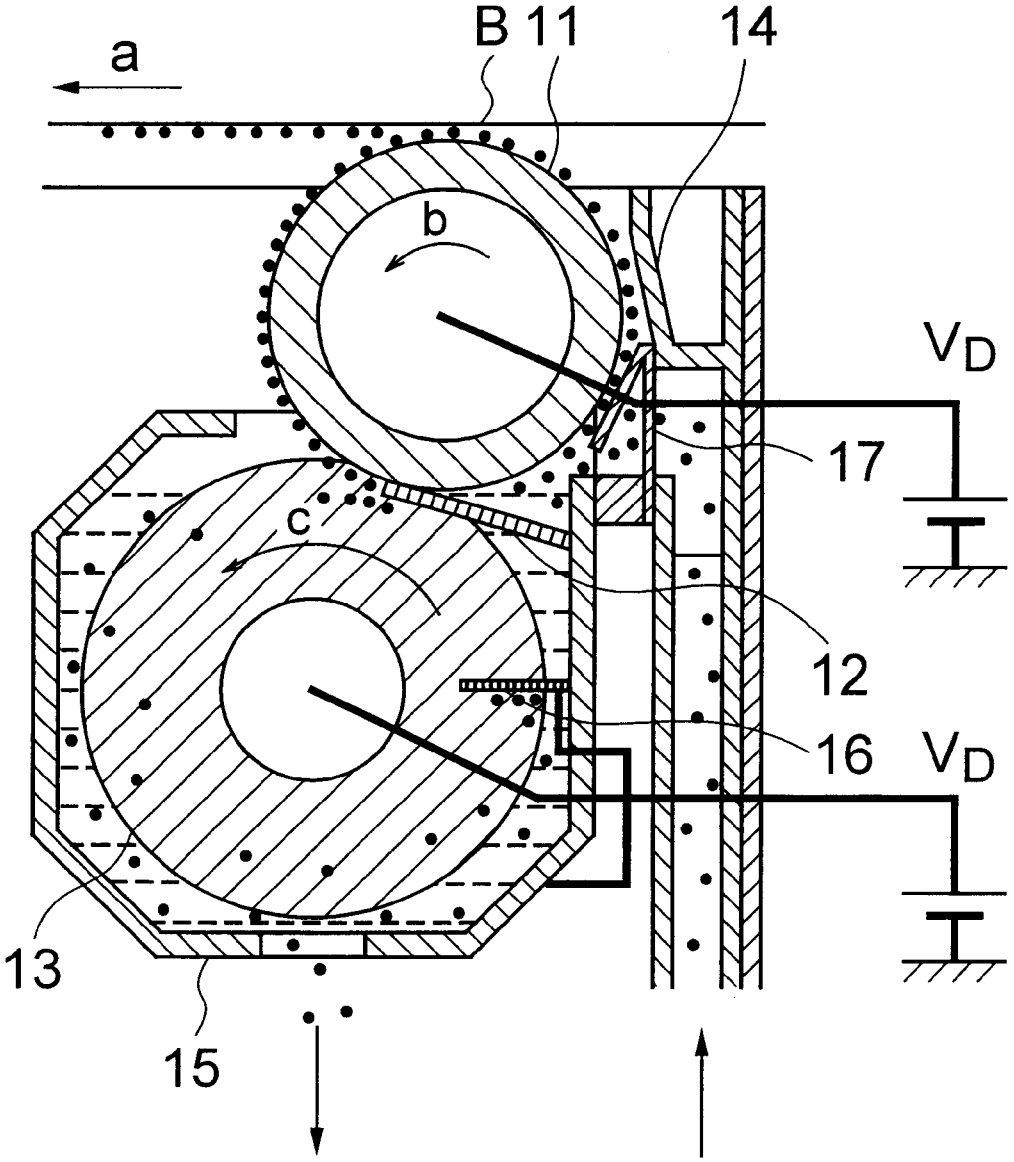
FIG. 5 is an illustration showing the state of toner particles during the printing of FIG. 2.

A wet image-forming apparatus according to the present invention is shown in FIGS. 2 to 4. A developing roller 11 rotates in a direction shown by an arrow "b" for developing electrostatic latent images formed on a photoreceptor B. A developing blade 12 for removing toner particles on the developing roller 11 cooperates with a brush roller 13 to remove toner particles from the developing blade 12. A manifold 14 supplies a liquid developer to the developing roller 11. A reservoir 15 stores the liquid developer in order to dip the brush roller 13 in the liquid developer during printing. A brush blade 16 removes particles adhering to the brush roller 13 while a shield 17 controls the flow of the liquid developer. A squeezing roller 18 removes the excessive developer on the photoreceptor B during the printing and cleans the photoreceptor B immediately before the apparatus is stopped. A wiping blade 19 is pressed against the squeezing roller 18 during the cleaning of the photoreceptor B. A squeezing support 20 supports the squeezing roller 18 and the wiping blade 19 and vertically changes the relative positions thereof with respect to the developing roller 11. A developing support 21 supports the developing roller 11, the manifold 14, the reservoir 15 and the other elements. Moreover, in the present embodiment, the same or similar voltages as that of the developing voltage $V_D$ applied to the developing roller 11 are applied to the brush roller 13, the reservoir 15 and the brush blade 16 during the operation.

The developing roller 11 has a cylindrical shape made of a metal, and both ends of its shaft are rotatably supported on the developing support 21. During the developing operation, the developing roller 11 keeps a slight spacing (about 150 micrometers) from the photoreceptor B and rotates in the direction indicated by the arrow "b". The developing voltage $V_D$ (about +400 V) is applied by a development terminal made of a plate-like metal member in contact with the shaft end to the developing roller 11. The developing voltage $V_D$ contributes to developing an electrostatic latent image on the photoreceptor B in conjunction with the liquid developer supplied from the manifold 14 to the slight spacing. Immediately before the apparatus is stopped upon the completion of the development operation, the developing roller 11 is separated from the photoreceptor B as shown in FIG. 3. When the cleaning of the photoreceptor B is finished, the rotation of the developing roller 11 is stopped and the developing voltage $V_D$ is interrupted as shown in FIG. 4.

The developing blade 12 is made of plate-like insulation material, commercially available as a product named "Esterlam Doctor-Blade" available from Esterlam International Company. A leading edge of the developing blade 12 is always in contact with the developing roller 11 to remove the toner particles adhering to the developing roller 11.

The brush roller 13 is rotatably supported to the developing support 21 in order to be always in contact with the developing blade 12. The brush roller 13 is a cylindrical member having a similar length to that of the developing roller 11. The brush roller 13 includes a roller portion having a conductive cylinder with a surface coated with semiconductive synthetic resin fibers (specific resistance value: $1\times10^3$ to $1\times10^8\Omega$-cm). The fibers can be made of materials such as rayon and nylon admixed with carbon powders, for instance. A metal shaft portion is also included in brush roller 13. The brush roller 13 is accommodated in the reservoir 15, and is driven to rotate in a direction shown by an arrow "c" in FIG. 2 during the development operation. Substantially the same voltage (+400 V) as the developing voltage is applied to the brush roller 13 by way of a metal brush terminal having a plate-like shape in contact with the shaft terminal of the brush roller 13. The voltage helps to remove the toner particles adhering to the developing blade 12.

The manifold 14 made of insulative material supplies a liquid developer having positively charged toner particles dispersed therein. The liquid developer is supplied to the developing roller 11 from a liquid developer tank by a circulation tank.

The brush roller 13, the developing blade 12 and the brush blade 16 are completely dipped-in the liquid developer stored in the reservoir 15 made of a plate-like metal during the printing. Upon the completion of printing, the liquid developer is drained out of the reservoir 15 through an aperture at a bottom of the reservoir 15. During printing, substantially the same voltage (+400 V) as the developing voltage $V_D$ is applied to the reservoir 15.

The brush blade 16 has applied to it substantially the same voltage (+400 V) as the developing voltage $V_D$. The brush blade 16 is made of plate-like metallic material and always in contact with the brush roller 13 to remove the toner particles adhering to the brush roller 13.

The shield 17 placed at an opening of the manifold 14 is composed of a thin plate insulation material. The shield 17 has a plurality of apertures through a vertical portion to control the flow of the liquid developer supplied to the developing roller 11.

The squeezing roller 18 is rotatably supported by the squeezing support 20. The squeezing roller is a cylindrical member longer than the developing roller 11. The rolling portion of the squeezing roller 18 is made of urethane rubber and the shaft portion is made of a metal. During printing, the squeezing roller 18 is pressed against the photoreceptor B at a specified force (i.e., 23 kgf) by a compressed coil spring (not shown) mounted on the squeezing support 20. The squeezing roller 18 subordinately rotates in a direction shown by an arrow "d" in FIG. 2 by frictionally engaging the photoreceptor B. The squeezing roller 18 removes excessive liquid developer adhering to the photoreceptor B. Immediately before the apparatus is stopped upon the completion of printing, the compressed coil spring stretches and the squeezing roller 18 is pressed against the photoreceptor B at a force (i.e., 0.9 kgf) weaker than that used during the printing. The squeezing roller 18 rotates in a direction shown by an arrow "e" in FIG. 3 which is reverse to the direction during the printing. This counter rotation of the squeezing roller 18 serves to clean the photoreceptor B. In addition, the counter rotation serves to remove the liquid developer accumulated during printing in the space between the photoreceptor B and the squeezing roller 18 upstream of the contact portion between the photoreceptor B and the squeezing roller 18. At this time, the wiping blade 19 made of urethane rubber is pressed against the outer periphery of the squeezing roller 18 to remove the liquid developer adhering to the outer periphery of the squeezing roller 18.

When printing data is input, the photoreceptor B starts to move in the direction shown by the arrow "a" in FIG. 2 and is charged to a potential of about +750 V by employing a Scorotron charger (not shown). Thereafter, a liquid developer circulation pump starts to supply a liquid developer containing positively charged toner particles from the manifold 14 to the developing roller 11. The developing roller 11 and the brush roller 13 rotate in the directions shown by the arrows "b" and "c", respectively. A developing potential $V_D$ of +400 V is applied to the developing roller 11, the brush roller 13, the reservoir 15 and the brush blade 16. The reservoir 15 stores the liquid developer, and the developing blade 12, the brush roller 13 and the brush blade 16 are completely dipped in the liquid developer. Then, a cam (not shown) for vertically moving the developing support 21 rotates to elevate the developing support 21 from a position at which the apparatus stops shown in FIG. 4 to a position at which the printing is conducted shown in FIG. 2. After elevation to the printing position, the developing roller 11 takes a position which is approximately 150 micrometers from the photoreceptor B. and the squeezing roller 18 is pressed against the photoreceptor B at a force of about 23 kgf by means of a compressed coil spring mounted on the squeezing support 20. A laser unit (not shown) conducts an exposure process to make an exposure portion potential +130 V to form electrostatic latent images on the photoreceptor B.

The liquid developer containing the toner particles supplied to the manifold 14 by the circulation pump passes through an aperture formed on the vertical portion of the shield 17. The aperture is positioned to permit the liquid developer to be supplied to the developing roller 11 at a top slanted portion of the shield 17. Rotation of the developing roller 11 in the direction shown by the arrow "b" conveys the liquid developer into a space between the photoreceptor B and the developing roller 11 (development nip). The toner particles adhere to the electrostatic latent images on the photoreceptor B in the development nip. An electric field between the exposed portion of the photoreceptor B and the developing roller 11 permits development of an image (a potential difference between the exposed portion potential +130 V and the developing potential $V_D$). At this time, the toner particles also adhere to the outer peripheral surface of the developing roller 11 because of the reverse developing phenomenon occurring due to an electric field between the non-exposed portion of the liquid developer and the developing roller 11 (a potential difference between the charged potential +750 V and the developing potential $V_D$).

The toner particles adhering to the outer peripheral surface of the developing roller 11 are removed by the developing blade 12 of which a leading edge is always in contact with the developing roller 11. The Toner particles adhering to the developing blade 12 are then removed therefrom by the brush roller 13 rotating in the direction shown by the arrow "c" while being always in contact with the developing blade 12. A voltage of +400 V, i.e., substantially the same as that of the developing potential $V_D$, is applied to the brush roller 13. As a result, most of the positively charged toner particles are re-dispersed in the liquid developer stored in the reservoir 15 after separation from the brush roller 13 due to electrical repulsion. A voltage of +400 V, substantially the same as the developing potential $V_D$, is applied to the toner particles remaining on the brush roller 13 which are completely removed by the brush blade 16 always in contact with the brush roller 13. The toner particles removed from the brush roller 13 are re-dispersed in the liquid developer stored in the reservoir 15. The liquid developer flows down through an. aperture formed on the bottom surface of the reservoir 15 by means of gravity and returns to the liquid developer tank (not shown). The liquid developer returned to the liquid developer tank is again supplied to the developing roller 11 by way of the manifold 14 by the liquid developer circulation pump (not shown).

The excessive liquid developer remaining on the photoreceptor B immediately after the development is squeezed off by the squeezing roller 18 which is pressed against the photoreceptor B at a force of about 23 kgf by the compressed coil spring mounted on the squeezing support 20. The images on the photoreceptor B defined by the remaining liquid developer appear as films after excess liquid developer is removed. Part of the liquid developer squeezed by the squeezing roller 18 collects in a space between the photoreceptor B and the squeezing roller 18 upstream of the contact portion therebetween. The majority of the liquid developer flows down from the squeezing roller 18 by means of gravity to return to the liquid developer tank (not shown).

Thereafter, the photoreceptor B proceeds to a drying unit (not shown) for drying the film-like images on the photoreceptor B. The photoreceptor B is then forwarded to a transferring unit where the developed images are transferred to paper.

Upon the completion of printing, the liquid developer circulation pump stops and the cam lowers the developing support 21 from the printing position shown in FIG. 2 to the position for cleaning the photoreceptor B with the squeezing roller 18 shown in FIG. 3. At this time, the length of the compressed coil spring mounted on the squeezing support 20 becomes greater than a length observed during the printing process (the force of compression of the spring is weakened). The coil spring in this extended position presses the squeezing roller 18 against the photoreceptor B at a force of about 0.9 kgf. The squeezing roller 18 rotating in a direction shown by an arrow "e" removes the liquid developer collected during printing in the space between the photoreceptor B and the squeezing roller 18 upstream of the contact portion therebetween. In addition, the squeezing roller 18 rotating as shown by arrow "e" also cleans the surface of the photoreceptor B. During this procedure, the wiping blade 19 is pressed against the outer peripheral surface of the squeezing roller 18 to remove the liquid developer therefrom.

The cam (not shown) further rotates to lower the developing support 21. When the developing support 21 is lowered from the position for cleaning the photoreceptor B with the squeezing roller 18 shown in FIG. 3 to the position for stopping the apparatus shown in FIG. 4, the squeezing roller 18 is separated from the photoreceptor B. In addition, the rotations of the squeezing roller 18, the developing roller 11 and the brush roller 13 are stopped. The wiping blade 19 is also separated from the outer peripheral surface of the squeezing roller 18. At this time, the liquid developer flows down through the aperture formed on the bottom surface of the reservoir 15 by means of gravity and the reservoir 15 is thus empty. Finally, all the voltages applied are interrupted and the progress of the photoreceptor B is stopped.

The brush roller 13 of the present embodiment includes a metallic shaft and a roller portion. The brush roller 13 is manufactured by attaching semi-conductive synthetic resin fibers to an outer surface, which enables the application of substantially the same voltage as the developing potential $V_D$ to the developing roller 11 by way of the brush terminal mounted on the shaft end. The reservoir 15 for accommodating the brush roller 13 is made of a conductive metallic plate, and substantially the same voltages to the developing potential $V_D$ are applied to the reservoir 15 and to the metallic brush blade 16 which is always in contact with brush roller 13.

The toner particles adhere to the developing roller 11 due to the reverse developing phenomenon because of the potential difference between the non-exposed portion of the photoreceptor B and the developing potential $V_D$ on the developing roller 11. The toner particles are removed by developing blade 12 and are mechanically removed from the front edge of the developing blade 12 by the brush roller 13. The majority of the toner particles separated from the brush roller 13 due to electrical charge repulsion are re-dispersed in the liquid developer in the reservoir 15 because the toner particles have the same polarity as that of the voltage applied to the brush roller 13. The toner particles remaining on the brush roller 13 are removed from the brush roller 13 by the brush blade 16 mounted in contact with the brush roller 13.

Although the roller portion of the brush roller 13 has been described as being manufactured by attaching the semi-conductive synthetic resin fibers, urethane foam can achieve a similar effect. The urethane foam can be prepared by expanding urethane rubber having a specific resistance between $1\times10^3\Omega$-cm and $1\times10^8\Omega$-cm. The metallic brush blade 16 employed in the present embodiment can be omitted if the urethane rubber having a specific resistance between $1\times10^3\Omega$-cm and $1\times10^8\Omega$-cm is employed. Thus, the brush blade 16 employed with the brush roller 13 for removing the toner particles from the developing blade 12 is not always required. The function provided by the brush blade 16 can be accommodated by the brush roller 13 having a urethane foam.

Although a photoreceptor belt B is employed in the present embodiment, the present invention is not so restricted and can also be applied in the case where a photosensitive drum is used. Although the reservoir has been described to be a metallic plate, an electroconductive plate prepared by sticking a metal foil on a dielectric plate can be employed.

Since the above embodiments are described only for examples, the present invention is not limited to the above embodiments and various modifications or alterations can be easily made therefrom by those skilled in the art without departing from the scope of the present invention.

What is claimed is:

1. A wet image-forming apparatus comprising:

a developing roller which rotates in a first direction for developing electrostatic latent images formed on a photoreceptor with a liquid developer;

a developing blade disposed in contact with a surface of said developing roller for removing toner particles adhering to the surface of said developing roller after developing;

a brush roller which rotates in said first direction for removing the toner particles from said developing blade; and a reservoir which stores the liquid developer for accommodating both of said developing blade and said brush roller to dip both in the liquid developer, wherein said developing roller, said brush roller and said reservoir are applied with a common developing voltage.

2. The wet image-forming apparatus as defined in claim 1, further comprising a brush blade disposed in direct contact with said brush roller for removing the toner particles adhering to said brush roller, said brush blade being made of an electroconductive or semi-conductive material.

3. The wet image-forming apparatus as defined in claim 2, wherein said brush blade is applied with said common developing voltage.

4. A wet image-forming apparatus, comprising:

a developing roller which rotates in a first direction for developing electrostatic latent images formed on a photoreceptor with a liquid developer;

a developing blade disposed in contact with a surface of said developing roller for removing toner particles adhering to the surface of said developing roller after developing;

a brush roller which rotates in said first direction for removing the toner particles from said developing blade;

a brush blade disposed in direct contact with said brush roller for removing the toner particles adhering to said brush roller, said brush blade being made of at least one of a metallic plate and a semiconductive urethane rubber having a specific resistance between $1\times10^3$ and $1\times10^8$ Ω-cm; and a reservoir which stores the liquid developer for accommodating both of said developing blade and said brush roller to dip both in the liquid developer, wherein said developing roller, said brush roller and said reservoir are applied with a common developing voltage.

5. A wet image-forming apparatus, comprising:

a developing roller which rotates in a first direction for developing electrostatic latent images formed on a photoreceptor with a liquid developer;

a developing blade disposed in contact with a surface of said developing roller for removing toner particles adhering to the surface of said developing roller after developing;

a brush roller which rotates in said first direction for removing the toner particles from said developing blade, said brush roller including a metallic shaft portion and a roller portion, said roller portion having a conductive cylindrical surface being covered with at least one of semi-conductive synthetic resin fibers having a specific resistance value between $1\times10^3$ and $1\times10^8$ Ω-cm and a semiconductive urethane rubber foam having a specific resistance between $1\times10^3$ and $1\times10^8$ Ω-cm; and a reservoir which stores the liquid developer for accommodating both of said developing blade and said brush roller to dip both in the liquid developer, wherein said developing roller, said brush roller and said reservoir are applied with a common developing voltage.

* * * * *